US006203577B1

(12) United States Patent
Yanai et al.

(10) Patent No.: US 6,203,577 B1
(45) **Date of Patent: *Mar. 20, 2001**

(54) SHRINK-PROOF TREATMENT OF CELLULOSIC FIBER TEXTILE

(75) Inventors: Yuichi Yanai; Takayuki Hirai; Masayoshi Oba; Kiyoshi Ikeda; Yasushi Takagi; Takeo Ishikawa; Kazuhiko Harada; Hirotaka Iida; Ryuichi Ito, all of Okazaki; Osamu Hasegawa, Tokyo, all of (JP)

(73) Assignee: Nisshinbo Industries, Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/177,124

(22) Filed: Oct. 22, 1998

Related U.S. Application Data

(63) Continuation-in-part of application No. 08/861,705, filed on May 22, 1997, now abandoned.

(30) Foreign Application Priority Data

| | | |
|---|---|---|
| May 23, 1996 | (JP) | 8-150470 |
| Sep. 10, 1996 | (JP) | 8-260166 |
| Sep. 10, 1996 | (JP) | 8-260169 |
| Sep. 11, 1996 | (JP) | 8-262490 |
| Oct. 2, 1996 | (JP) | 8-281342 |
| Oct. 22, 1996 | (JP) | 8-298217 |
| Oct. 30, 1997 | (JP) | 9-314469 |

(51) Int. Cl.[7] ..... D06M 11/61; D06M 11/84

(52) U.S. Cl. ..... 8/125; 8/116.4; 8/120; 8/139; 8/137; 8/116.1

(58) Field of Search ..... 8/116.4, 120, 125, 8/139, 137, 116.1

(56) References Cited

U.S. PATENT DOCUMENTS

| | | | | |
|---|---|---|---|---|
| 3,264,054 | * | 8/1966 | Reinhardt et al. | 8/116.6 |
| 3,406,006 | * | 10/1968 | Lindberg et al. | 8/125 |
| 3,642,428 | * | 2/1972 | Getchell et al. | 8/183 |
| 4,295,847 | * | 10/1981 | Petersen et al. | 8/189 |
| 5,910,279 | * | 6/1999 | Yanai et al. | 264/282 |
| 6,042,616 | * | 3/2000 | Yanai et al. | 8/115.51 |

FOREIGN PATENT DOCUMENTS

| | | | |
|---|---|---|---|
| 801164 | * | 10/1997 | (EP) . |
| 808939 | * | 11/1997 | (EP) . |
| 900874 | * | 3/1999 | (EP) . |
| 59-163465 | * | 9/1984 | (JP) . |
| 6-158535 | * | 6/1994 | (JP) . |

OTHER PUBLICATIONS

Bredereck, Melliand Textilberichte, vol. 59, No. 8, pp. 648–652. (English translation), Aug. 1978.*

Bredereck et al., Melliand Textilberichte, vol. 70, No. 2, pp. 116–125. (English translation), Feb. 1989.*

* cited by examiner

*Primary Examiner*—Alan Diamond

(74) *Attorney, Agent, or Firm*—Birch, Stewart, Kolasch & Birch, LLP

(57) ABSTRACT

A method for shrink-proofing a cellulosic fiber textile that involves liquid ammonia treatment, hot water or alkali treatment under tension or under no tension, and with optional resin treatment.

6 Claims, 3 Drawing Sheets

SHRINK-PROOF TREATMENT OF CELLULOSIC FIBER TEXTILE

CROSS REFERENCE TO RELATED APPLICATION

This application is a continuation-in-part of application Ser. No. 08/861,705 filed on May 22, 1997, now abandoned, the entire contents of which are hereby incorporated by reference.

BACKGROUND OF THE INVENTION

1. Field of the Invention

This invention relates to a method for the shrink-proof treatment of a cellulosic fiber textile. More particularly, it relates to a method for treating a cellulosic fiber textile to be fully shrink-proof without a substantial loss of strength so that it may experience minimal shrinkage after washing and minimal hand-and-feel hardening after repetitive washing.

2. Prior Art

Heretofore, cellulosic fiber textiles have been widely used as clothing materials since they have the advantages of moderate moisture absorption, good hand-and-feel textures, and ease of treatment. Such cellulosic fiber textiles, however, suffer from shrinkage after washing and hand-and-feel hardening after repetitive washing.

The cause of the shrinkage after washing is correlated to two phenomena. One phenomenon is the deformation of woven and knitted goods by various forces applied during their manufacture and treatment. More particularly, as washing causes woven and knitted goods to be tossed and turned in a free state without the application of force, they tend to resume their original stable state, inviting shrinkage. Such shrinkage can be prevented by mechanical methods such as is typified by sanforization. The method using a sanforizing machine of the rubber belt or felt blanket type is to impart shrink-proof by physically and continuously compressing the fabric for contraction to reduce the shrinkage potential of the fabric. However, the method cannot achieve a full reduction of the shrinkage potential of thick fabric pieces or hard finished fabrics.

The other phenomenon is the shrinkage of woven and knitted goods as a result of individual fibers absorbing water to swell and to increase their cross-sectional area. This shrinkage occurs upon the absorption of water. After the fabric is dried to remove the water, the fabric tissue cannot recover its original size prior to swelling by itself. The fabric remains shrunk.

SUMMARY OF THE INVENTION

An object of the present invention is to provide a method for treating a cellulosic fiber textile to be fully shrink-proof without a substantial loss of strength so that it may experience minimal shrinkage after washing and minimal hand-and-feel hardening after repetitive washing.

In a first aspect of the present invention, there is provided a method for the shrink-proof treatment of a natural cellulosic fiber textile, comprising the steps of:

treating the fiber textile with liquid ammonia, thereby converting the cellulose I or II crystalline structure in the fiber textile to the cellulose III crystalline structure so that the content of cellulose III crystalline structure in the fiber textile is 10 to 35% based on the entire crystals, and treating the fiber textile under tension or under no tension with hot water in the following condition of (a) to (e):

(a) at a temperature of 98° C. to less than 105° C. for 1.5 to 5 hours, (b) at a temperature of 105° C. to less than 115° C. for 1 to 5 hours, (c) at a temperature of 115° C. to less than 125° C. for 40 minutes to 5 hours, (d) at a temperature of 125° C. to less than 135° C for 30 minutes to 5 hours, or (e) at a temperature of 135° C. to 150° C. for 20 minutes to 5 hours, thereby obtaining a natural cellulosic fiber textile having a minimal shrinkage after washing.

In a second aspect of the present invention, there is provided a method for the shrink-proof treatment of a regenerated cellulosic fiber textile, comprising the steps of:

treating the fiber textile with liquid ammonia thereby converting cellulose II crystalline structure in the fiber textile to the cellulose III crystalline structure, and treating the fiber textile under tension or under no tension with hot water in the following condition of (a) to (e):

(a) at a temperature of 98° C. to less than 105° C. for 1.5 to 5 hours, (b) at a temperature of 105° C. to less than 115° C. for 1 to 5 hours, (c) at a temperature of 115° C. to less than 125° C. for 40 minutes to 5 hours, (d) at a temperature of 125° C. to less than 135° C. for 30 minutes to 5 hours, or (e) at a temperature of 135° C. to 150° C. for 20 minutes to 5 hours, thereby obtaining a regenerated cellulosic fiber textile having a minimal shrinkage after washing.

In the third aspect of the present invention, there is provided a method for the shrink-proof treatment of a cellulosic fiber textile, comprising the steps of:

treating the fiber textile with a liquid ammonia for 5 to 40 seconds, and treating the fiber textile under tension or under no tension with caustic alkali aqueous in the following condition of (a) or (b):

(a) at a temperature of 90° C. to 150° C. for 1 minute to 5 hours in a caustic alkali concentration of 0.1% by weight to less than 10% by weight, or (b) at a temperature of −10° C. to less than 90° C. for 20 seconds to 24 hours, in a caustic alkali concentration of 10% by weight to 40% by weight, thereby obtaining a cellulosic fiber textile having minimal shrinkage after washing.

In the fourth aspect of the present invention, there is provided a method for the shrink-proof treatment of a cellulosic fiber textile, comprising the steps of:

treating the fiber textile with liquid ammonia for 5 to 40 seconds, and treating the fiber textile under tension or under no tension with a weak alkali aqueous solution having a weak alkali concentration of 0.1% by weight to 15% by weight at a temperature of 90° C. to 150° C. for 10 minutes to 5 hours, thereby obtaining a cellulosic fiber textile having minimal shrinkage after washing.

We have found that by treating a cellulosic fiber textile with liquid ammonia and then treating the fiber textile under tension or under no tension with hot water or an alkali under the specific condition described above, the cellulosic fiber textile can be rendered fully shrink-proof so that it may experience minimal shrinkage after washing and minimal hand-and-feel hardening after repetitive washing. This is accomplished without a substantial loss of strength.

More particularly, when a cellulosic fiber textile is impregnated with liquid ammonia, the liquid ammonia penetrates into not only the amorphous regions, but also the crystalline regions of the cellulose to break down the hydrogen bonds so that the fibers in their entirety are swollen. Thereafter, heat treatment is carried out to evaporate the liquid ammonia whereupon hydrogen bonds are newly formed and a cellulose III crystalline structure is created at least partially in the crystalline region. The crystals are fixed in a swollen state. This results in a lower crystallinity. When such a fabric is given a resin finish the crease and shrink-proof properties are improved with a slight loss of strength. This fact is well known in the art.

In contrast, by treating a cellulosic fiber textile with hot water or an alkali subsequent to liquid ammonia treatment under the specific condition described above, the cellulose III crystalline structure is restored to the cellulose I or II crystalline structure, during which process the swollen state is maintained due to the penetration of hot water or the alkali. Then, the fiber structure is set as swollen and relaxed. As a result, the influence of swelling and tension relaxation by water upon washing is minimized or eliminated. Shrink-proof treatment is accomplished in this way.

Subsequent resin treatment on the thus treated cellulosic fiber textile can impart improved crease or shrink-proof properties without a substantial loss of strength when compared with the prior art resin treatment.

More particularly, the prior art resin treatment of a cellulosic fiber textile has the tendency that as the amount of resin added increases, the crease or shrink-proof properties are improved, but the tensile strength is reduced at the same time. An improvement in the crease or shrink-proof properties is achieved by introducing crosslinks between the cellulosic fibers to stabilize the hydrogen bonds while a lowering of the tensile strength occurs because of the introduction of crosslinks which invite the likelihood of local brittle fracture. These are contradictory to each other. It is desired to find a compromise between the shrink-proof improvement and strength loss. Since cellulosic fibers have a heterogeneous structure including crystalline and amorphous portions or skin and interior portions, it is desired to achieve a uniform distribution of the crosslinking sites in order to prevent strength lowering.

Such a demand is satisfied as follows. When fibers which have been fully swollen by liquid ammonia treatment are treated under tension or under no tension with hot water or an alkali under the specific condition described above, the fiber structure in a swollen state undergoes some changes to improve the accessibility of the cellulose, resulting in an ideal cellulose crystal structure having crosslinking points distributed as uniformly as possible, achieving improved crease or shrink-proof properties. When the fibers in such a state are further treated with a resin, a smaller amount of resin is sufficient to improve the shrink-proof properties. The smaller amount of resin added leads to less lowering of the strength. A reasonable compromise between the above-mentioned contradictory demands is reached in this way.

The shrink-proof treatment method of the present invention is successful in producing a fully shrink-proof cellulosic fiber textile, without a substantial loss of strength, which experiences minimal shrinkage after washing and minimal hand-and-feel hardening after repetitive washing. Especially, improved crease or shrink-proof-properties can be imparted to even such thin, low strength fabrics made of cotton, linen, rayon, etc. while maintaining a practically acceptable strength.

DETAILED DESCRIPTION OF THE INVENTION

Figure 1:
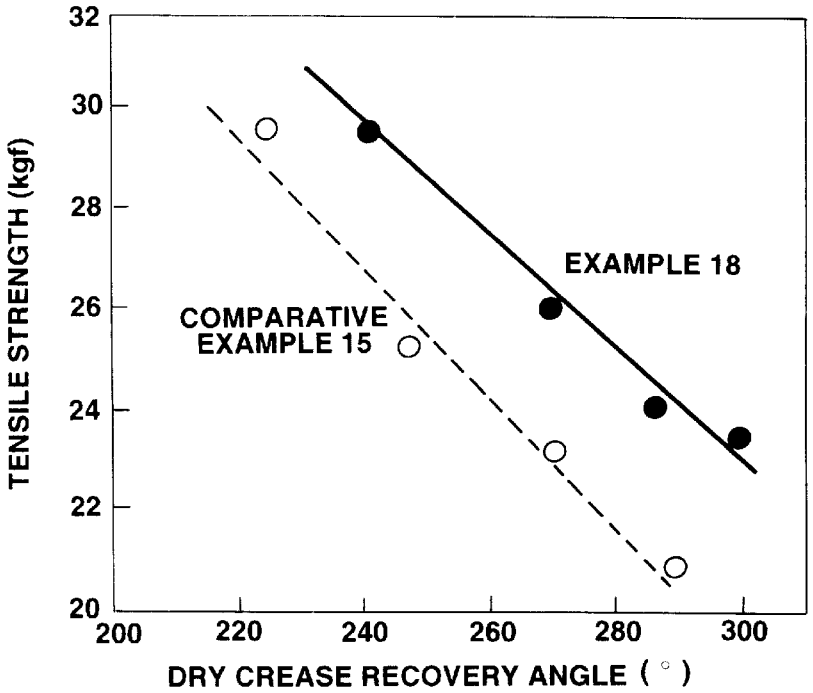
FIG. 1 is a graph showing the dry crease-proof property vs. the tensile strength of the fabric pieces treated in Example 18 and Comparative Example 15.

The shrink-proof treatment method of the invention involves the step (1) of treating a cellulosic fiber textile with liquid ammonia, and the step (2) of treating the fiber textile under tension or under no tension with hot water or an alkali.

A cellulosic fiber textile which can be processed by the method of the invention is composed of cellulosic fibers including natural fibers and regenerated cellulose fibers, for example, cotton, hemp, rayon, polynosics, cuprammonium fibers, and high-strength regenerated cellulose fibers (available under the trade name of Tencel, for example). These natural fibers and regenerated cellulose fibers may take the form of composite fibrous materials obtained by blending with other fibers such as synthetic fibers, typically polyesters and polyamides. The composite fibrous materials should preferably have a greater content of cellulosic fibers, more preferably a cellulosic fiber content of at least 50% by weight. The alkali treatment can be applied only to fibers, which are insoluble in the alkali solution to be used.

The cellulosic fiber textile, which can be used herein, includes woven fabrics, knitted goods and non-woven fabrics. If desired, the textile may be subjected to pretreatment such as singeing, desizing, scouring, bleaching, and mercerizing. Also, the textile may have been dyed or printed.

First, the cellulosic fiber textile is treated with liquid ammonia, for example, by impregnating the textile with liquid ammonia kept at a temperature of −33° C. or lower under atmospheric pressure. The said impregnating means include dipping in liquid ammonia, spraying of liquid ammonia, and coating of liquid ammonia. The said impregnating time may be properly selected in the range of about 5 to 40 seconds.

Liquid ammonia is most often used to induce a transition of cellulose I or II in the cellulosic fiber textile into cellulose III, although lower alkylamines such as methylamine or ethylamine may be used if desired. At the end of the process, the ammonia is removed from the liquid ammonia-treated cellulosic fiber textile by heating.

The liquid ammonia treatment causes the cellulose I or II crystalline structure to convert to the cellulose III crystalline structure in proportion to the impregnating time. The content of cellulose III crystalline structure based on the entire crystals reaches about 10% at an impregnating time of 5 seconds, about 15% at 8 seconds, about 25% at 12 seconds, about 35% at 18 seconds, and about 40% at 20 seconds or longer.

In case of the natural cellulosic fiber, it is preferred that the content of cellulose III crystalline structure is 10 to 35% based on the entire crystals when hot water treatment is carried out subsequent to the liquid ammonia treatment. No satisfactory shrink-proof would be expectable with a cellulose III content of less than 10% whereas hand-and-feel would become hard with a cellulose III content of more than 35%.

Next, the cellulosic fiber textile having a cellulose III crystalline structure created by the liquid ammonia treatment is subjected to hot water treatment or an alkali treatment while it is kept under tension or under no tension, thereby causing a transition of at least a part of the cellulose III crystalline structure in the cellulosic fiber textile into a cellulose I or II crystalline structure.

More specifically, according to the invention, at least a part of the cellulose III crystalline structure is converted into a cellulose I or II crystalline structure by either of the following procedures of: (a) first converting the cellulose I crystalline structure of the natural cellulose into cellulose III through liquid ammonia treatment and converting it back to cellulose I through hot water treatment; (b) first converting the cellulose II crystalline structure of regenerated cellulose into cellulose III through liquid ammonia treatment and converting it back to cellulose II through hot water treatment; (c) first converting the cellulose I crystalline structure of the native cellulose into cellulose II through mercerization, then converting it into cellulose III through liquid ammonia treatment and converting it back to cellulose II through hot water treatment; and (d) first converting the cellulose I or II crystalline structure of the natural cellulose into cellulose III through liquid ammonia treatment and converting it to cellulose II through caustic alkali treatment.

During transition of the cellulose crystalline structure, all the cellulose crystals do not necessarily undergo transition. The crystalline state of the final product is a mixture of the cellulose crystalline states created in the steps it has passed through.

Hot water treatment is carried out by dipping the cellulosic fiber textile in hot water at a temperature of 98° C. or more. More particularly, an apparatus capable of hot water treatment under high pressure is used. For example, hot water treatment is carried out by high-pressure liquid flow dyeing machines, high-pressure paddle dyeing machines, high-pressure jigger dyeing machines, high-pressure drum dyeing machines, or high-pressure beam dyeing machines.

The condition for the hot water treatment is as follows:

| | |
|---|---|
| (a) temperature: | 98° C. to less than 105° C. |
| treatment time: | 1.5 hours or more, preferably 2 hours or more, |
| (b) temperature: | 105° C. to less than 115° C. |
| treatment time: | 1 hour or more, preferably 1.5 hours or more, |
| (c) temperature: | 115° C. to less than 125° C. |
| treatment time: | 40 minutes or more, preferably 1 hour or more, |
| (d) temperature: | 125° C. to less than 135° C. |
| treatment time: | 30 minutes or more, preferably 1 hour or more, or |
| (e) temperature: | 135° C. to 150° C. |
| treatment time: | 20 minutes or more, preferably 1 hour or more |

The upper limit of the treatment time is 5 hours.

The hot water treatment causes at least a portion, preferably at least 25%, more preferably at least 40% of the cellulose III crystalline structure in the fiber textile to convert back to the cellulose I or II crystalline structure. More particularly, when the crystalline structure is converted from cellulose I to cellulose III by the liquid ammonia treatment, it can be converted back to cellulose I by the hot water treatment. When started from cellulose II, the crystalline structure can be converted back to cellulose II by the hot water treatment. The percent conversion of cellulose III to cellulose I or II is calculated according to {(a percent content of cellulose III in the entire crystals prior to hot water treatment)−(a percent content of cellulose III in the entire crystals subsequent to hot water treatment)}/(a percent content of cellulose III in the entire crystals prior to hot water treatment)×100%.

Hot water treatment is carried out while the textile is kept either under tension or under no tension. Depending on the type and application of the textile, hot water treatment is carried out using a high-pressure liquid flow-dyeing machine, a high-pressure drum dyeing machine or a high-pressure paddle-dyeing machine while the textile is kept under no tension. Alternatively, hot water treatment is carried out using a high-pressure beam dyeing machine or a high-pressure jigger-dyeing machine while the textile is kept in a flat state (or under slight tension).

When hot water treatment is carried out on the textile kept under no tension using a high-pressure liquid flow dyeing machine, a high-pressure drum dyeing machine or a high-pressure paddle dyeing machine, the stresses in the textile material are released, resulting in improved shrink-proof. As additional advantages, the wet/dry crease-proof properties are improved due to the setting effect of the hot water treatment, crispness ("Hari") and resilience ("Koshi") is imparted, and the surface appearance is changed.

On the other hand, when hot water treatment is carried out on the textile kept in a flat state (or under slight tension) using a high-pressure beam dyeing machine or a high-pressure jigger dyeing machine, advantages are obtained in that no creases or irregularities are introduced into the textile and the selvage is not rolled since the textile is kept flat during such hot water treatment. Treatment on a mass scale becomes possible.

The hot water treatment is applicable to dyed and printed textiles. In such cases, the cellulosic fiber textile is dyed or printed prior to hot water treatment. Since hot water treatment need not use basic or acidic aids such as caustic soda and acetic acid, the hot water treatment of dyed and printed textiles does not detract from the color or dye fastness. Due to the eliminated need for a resin finish, little lowering of the strength occurs. Without a resin finish, the hot water treatment of a cellulosic fiber textile at a zero tension, in a relaxed state, yields shrink-proof natural cellulose fiber woven fabrics having a percent warp wash-shrinkage after 10 cycles of washing of up to 1.5% for cotton fabric, up to 2.0% for linen fabric, and up to 2.0% for ramie fabric. There can be also obtained shrink-proof natural cellulose fiber knitted goods such as single tuck cotton knitted goods having a total percent warp/weft wash-shrinkage after 10 cycles of washing of up to 15.0%. There can be further obtained shrink-proof regenerated cellulose fiber woven fabrics having a percent warp wash-shrinkage after 10 cycles of washing of up to 3.0% for rayon spun fabric, up to 3.5% for rayon filament x rayon spun fabric and up to 2.0% for cuprammonium rayon fabric. It is noted that the percent shrinkage is determined by washing a fabric according to the JIS L-217 103 method, followed by tumble-drying.

For alkali treatment, a caustic alkali or weak alkaline substance is used. Caustic alkali treatment is carried out using well known apparatus such as mercerizing machines. More particularly, the cellulosic fiber textile is impregnated with an aqueous solution of a caustic alkali, thereby converting at least a part of the cellulose III crystalline structure into a cellulose II crystalline structure. The caustic alkali used herein is typically lithium hydroxide (LiOH), sodium hydroxide (NaOH) or potassium hydroxide (KOH), with sodium hydroxide being preferred. Other alkaline chemicals may be used if necessary.

The caustic alkali treatment is carried out under the following condition:

| | | |
|---|---|---|
| (a) | alkaline concentration: | 0.1 to less than 10% by weight, preferably 0.2 to 5% by weight |
| | temperature: | 90° C. to 150° C., preferably 98° C. to 150° C., more preferably 110° C. to 140° C. |
| | treatment time: | 1 minute to 5 hours, preferably 10 minutes to 5 hours, more preferably 20 minutes to 3 hours, or |
| (b) | alkaline concentration: | 10 to 40% by weight, preferably 15 to 30% by weight |
| | temperature: | −10° C. to less than 90° C., preferably 10° C. to 40° C. |
| | treatment time: | 20 seconds to 24 hours, preferably 1 minute to 12 hours, more preferably 3 minutes to 5 hours |

In case of the weak alkali treatment, one or more of alkaline substances are used. Examples of the weak alkaline substances include carbonates, hydrogen carbonates, phosphates, hydrogen phosphates, and organic acid salts such as acetate, formate, citrate, malate and succinate of alkaline metals such as Na, K and Li and alkaline earth metals such as Ca, Ba and Mg.

The organic acid salts include partially neutralized salts such as sodium hydrogen citrates.

The condition for the weak alkali treatment is as follows:

| | |
|---|---|
| alkaline concentration: | 0.1 to 15% by weight, preferably 0.2 to 10% by weight |
| temperature: | 90° C. to 150° C., preferably 98° C. to 150° C., more preferably 110° C. to 140° C. |
| treatment time: | 10 minutes to 5 hours, preferably 20 minutes to 3 hours |

The alkali treatment would become ineffective if the alkali concentration is too low. If the alkali concentration is too high, no further improvement is recognized and there would result the drawback that a subsequent neutralizing step to remove the alkali requires a more time and cost.

The above-mentioned low- and high-temperature alkali treatments can be done while the cellulosic fiber textile is kept under tension or under no tension.

The amount of alkali aqueous solution applied to the cellulosic fiber textile is preferably at least 50% by weight of a portion of the cellulosic fiber textile to be impregnated. Where the alkali aqueous solution is applied throughout the cellulosic fiber textile, a mangle padder may be used. Where the alkali aqueous solution is applied to select portions of the cellulosic fiber textile, a printing machine as used in printing techniques may be used.

If desired, the cellulosic fiber textile can be dyed or printed prior to the application of the alkali aqueous solution.

The above alkali treatment is carried out while the cellulosic fiber textile is kept under tension or under no tension. Depending on the type and application of the textile, the alkali treatment is carried out using a liquid flow dyeing machine, a drum dyeing machine or a paddle dyeing machine while the textile is kept under no tension, or using mercerizing machines while the textile is kept under tension. The alkali treatment under no tension gives the same advantages as achieved with the hot water treatment.

The alkali treatment under tension using a mercerizing machine has the advantages that no creases or irregularities are introduced into the textile and the selvage is not rolled since the textile is kept flat during the alkali treatment, and treatment on a mass scale is possible. In this case, the treating time is usually about 20 to 80 seconds.

The thus alkali treated cellulosic fiber textile is then treated with an acid for neutralizing the alkali and washed with water. The acid used herein includes inorganic acids such as sulfuric acid and hydrochloric acid and organic acids such as acetic acid and formic acid.

The above-mentioned method involving liquid ammonia treatment and subsequent hot water or alkali treatment has several advantages. Since resin as typified by formaldehyde are not used at all, no formaldehyde is left in the textile. A fully shrink-proof cellulosic fiber textile, which experiences minimal shrinkage after washing and minimal hand-and-feel hardening after repetitive washing, is obtained without a substantial loss of strength. The invention is effective for imparting good shrink-proof to pieces of thick fabric or hard finished fabric as well as giving an improved luster and dyeing density.

According to the shrink-proofing method of the invention, after the above-mentioned liquid ammonia treatment and subsequent hot water or alkali treatment under tension or under no tension, resin finishing can be carried out if desired.

The resin used herein is any of the compounds that react-with a hydroxyl group of cellulose to form a crosslink, for example, aldehydes such as formaldehyde, glyoxal, and glutaraldehyde, epoxy compounds such as diglycidyl ether, polycarboxylic acids such as tetrabutane carboxylic acid, and cellulose reactive N-methylol compounds such as dimethylol urea, trimethylol melamine, dimethylol ethylene urea, and dimethylol dihydroxy ethylene urea. Of these, cellulose reactive N-methylol compounds are preferred because of the good balance of the crease or shrink-proof improvement and the textile strength loss.

An appropriate amount of such a resin added is 1 to 10% by weight, especially 2 to 6% by weight calculated as solids based on the weight of the cellulosic fiber textile to be treated therewith. Less than 1% of the resin would be less effective for a resin finish whereas more than 10% of the resin would induce a substantial loss in strength.

For the resin according to the invention, reaction of the cellulosic fiber textile with formaldehyde in the vapor phase, which is known as the VP reaction, is advantageously employable because of the effective crease or shrink-proof improvements. For the details of VP reaction, reference should be made to the Journal of the Japanese Cellulosic Society, Vol. 2, page 22.

In the VP reaction, the amount of formaldehyde added is preferably 0.1 to 3% by weight calculated as solids based on the weight of the cellulosic fiber textile. This is because if formaldehyde having a smaller molecular weight than the N-methylol compounds is added in the same amount as the N-methylol compounds, too much crosslinking is introduced and causes a drop in strength. Less than 0.1% of formaldehyde would be less effective for the resin finish whereas more than 3% of formaldehyde would induce a substantial drop in strength.

In the resin treatment step, a catalyst may be added for increasing the reactivity of the resin with the cellulose to achieve rapid resin treatment. The catalyst used herein is any of the catalysts commonly used for resin treatment, for example, borofluorides such as ammonium borofluoride, sodium borofluoride, potassium borofluoride, and zinc borofluoride, neutral metal salt catalysts such as magnesium chloride, magnesium sulfate and magnesium nitrate, and inorganic acids such as phosphoric acid, hydrochloric acid, sulfuric acid, sulfurous acid, hyposulfurous acid, and boric acid. If desired, the catalyst is combined with a co-catalyst, for example, organic acids such as citric acid, tartaric acid, malic acid, and maleic acid.

If desired, an auxiliary agent is added to the resin for ensuring a smooth reaction of the resin with the cellulose. That is, the auxiliary agent functions to promote the reaction of the resin with the cellulose, to render the crosslinking reaction uniform as a reaction solvent, and to swell the cellulose. Exemplary auxiliary agents include polyhydric alcohols such as glycerin, ethylene glycol, polyethylene glycol, and polypropylene glycol; ether alcohols such as ethylene glycol monoethyl ether, diethylene glycol monoethyl ether, ethylene glycol monomethyl ether, diethylene glycol monomethyl ether, and diethylene glycol monobutyl ether; nitrogenous solvents such as dimethylformamide, morpholine, 2-pyrrolidone, dimethylacetamide, and N-methylpyrrolidone; and esters such as ethyl acetate, isopropyl acetate, butyl acetate, amyl acetate, ethylene glycol monomethyl ether acetate, ethylene glycol monoethyl ether acetate and γ-butyrolactone.

It is noted that in addition to the above-mentioned chemicals, other additives can be added to the resin if desired, for example, softeners for hand-and-feel adjustment and formaldehyde scavengers for reducing the concentration of free formaldehyde.

Any desired method may be used to apply the resin to the cellulosic fiber textile. A choice may be made from among the well-known methods such as pad drying and the vapor-phase (VP) reaction of formaldehyde. The pad drying method involves dipping a piece of the fabric in a liquid preparation of the resin, squeezing the fabric at a squeeze rate of 50 to 120%, and drying the fabric at an ambient temperature of about 70 to 100° C. to remove the water. A long drying time is required at an ambient temperature below 70° C. whereas at an ambient temperature above 100° C., migration of the resin can occur, resulting in a non-uniform distribution of the resin. Thereafter, the cellulose together with the resin is heat treated at a temperature of 120 to 170° C., especially 130 to 160° C. for 1 to 15 minutes, especially 2 to 10 minutes, to induce crosslinking. The temperature and time of heat treatment vary with the type and amount of resin, the type and amount of catalyst, and the like. Reaction would be slow at a heat treating temperature of less than 120° C. whereas a heat treating temperature of higher than 170° C. would cause yellowing of the fabric.

The VP reaction method uses formaldehyde as the resin and applies formaldehyde in the vapor phase to the fabric. In the usual procedure, a softener, polyethylene glycol, etc. are previously applied to the fabric by the pad drying method or the like. The fabric is placed in a closed container, into which formaldehyde and an acidic gas such as sulfur dioxide are introduced whereby the fabric adsorbs the gaseous compounds. The fabric is then heated to induce crosslinking. Preferably, the amount of formaldehyde bonded is about 0.1 to 3% by weight of the fabric, the temperature is 20 to 160° C. and the treating time is about 1 to 60 minutes.

In the embodiment wherein the shrink-proof treatment is followed by resin treatment, the amount of resin added can be extremely reduced as compared with the conventional resin treatment, which contributes to a reduced drop in the fabric strength. A more crease or shrink-resistant cellulosic fiber textile is obtained. Even in the case of such thin, low strength fabrics as cotton, linen and rayon, a high degree of crease or shrink-proofing can be imparted while maintaining a practically acceptable strength.

After the shrink-proof treatment according to the invention, the cellulosic fiber textile may be subjected to a final finishing treatment such as tentering and hand-and-feel adjustment.

EXAMPLES

Examples of the present invention are given below by way of illustration and not by way of limitation.

Example 1

Plain weave cotton 100% fabric of 50-count single yarn (warp density 148 yarns/inch, weft density 80 yarns/inch) was conventionally bleached, treated with liquid ammonia for 10 seconds, and heated to evaporate the ammonia. The fabric was then treated with hot water under no tension at 130° C. for 2 hours by means of a high-pressure liquid flow-dyeing machine, followed by dewatering, drying, and tentering.

Example 2

Treatment as in Example 1 was done on a plain weave linen 100% fabric of 60-count single yarn (warp density 60 yarns/inch, weft density 52 yarns/inch).

Example 3

Treatment as in Example 1 was done on a plain weave ramie 100% fabric of 60-count single yarn (warp density 52 yarns/inch, weft density 56 yarns/inch).

Example 4

Treatment as in Example 1 was done on an ordinary single tuck cotton knit obtained by knitting 40-count two-folded yarns of cotton by a knitting machine with a cylinder diameter of 30 inches and a needle density of 18 needles/inch.

Comparative Example 1

The procedure of Example I was repeated except that the liquid ammonia treatment was omitted.

Comparative Example 2

The procedure of Example 2 was repeated except that the liquid ammonia treatment was omitted.

Comparative Example 3

The procedure of Example 3 was repeated except that the liquid ammonia treatment was omitted.

Comparative Example 4

The procedure of Example 4 was repeated except that the liquid ammonia treatment was omitted.

The woven and knitted fabrics of Examples 1 to 4 and Comparative Examples 1 to 4 were subjected to a washing test (JIS L-217 103 method) involving 1 cycle of washing or 10 cycles of washing, followed by tumble drying. The woven fabric was measured for its warp shrinkage. For the knit fabric, the sum of the warp and weft shrinkage was determined. The results are shown in Table 1.

TABLE 1

| | | Cotton | | Linen | | Ramie | | Cotton knit | |
|---|---|---|---|---|---|---|---|---|---|
| | | E1 | CE1 | E2 | CE2 | E3 | CE3 | E4 | CE4 |
| Warp shrinkage (%) | 1 cycle of washing | 0.7 | 1.7 | 0.4 | 3.0 | 0.4 | 1.7 | 12.0 | 23.0 |
| | 10 cycles of washing | 1.1 | 4.0 | 1.4 | 4.3 | 1.1 | 3.0 | 15.0 | 25.0 |
| Cellulose III content (%) | Before treatment | 20.5 | 0 | 18.4 | 0 | 24.9 | 0 | — | — |
| | After treatment | 4.7 | 0 | 10.5 | 0 | 11.7 | 0 | — | — |
| Crystal conversion from cellulose III to cellulose I (%)* | | 77.1 | 0 | 43.1 | 0 | 46.9 | 0 | — | — |

*The contents of cellulose I, II and III crystalline structures were determined by analyzing the fabric by means of a wide angle X-ray diffractometer to produce a diffraction chart, separating peaks characteristic of the respective crystal types from the chart using a peak separating program, and calculating the ratio of peak areas.

Example 5

A plain weave spun rayon 100% fabric of 30-count single yarn (warp density 68 yarns/inch, weft density 60 yarns/inch) was conventionally bleached, treated with liquid ammonia for 10 seconds, and heated to evaporate the ammonia. The fabric was then treated with hot water under no tension at 130° C. for 2 hours by means of a high-pressure liquid flow-dyeing machine, followed by dewatering, drying, and tentering.

Example 6

Treatment as in Example 5 was done on a plain weave warp rayon filament fabric of 120-denier rayon filaments as the warp (warp density 120 yarns/inch) and 30-count single yarn rayon staples as the weft (weft density 60 yarns/inch).

Example 7

Treatment as in Example 5 was done on a plain weave cuprammonium rayon 100% fabric of 75-denier cuprammonium rayon filaments as the warp (warp density 144 yarns/inch) and 120-denier cuprammonium rayon filaments as the weft (weft density 87 yarns/inch).

Comparative Example 5

The procedure of Example 5 was repeated except that the liquid ammonia treatment was omitted.

Comparative Example 6

The procedure of Example 6 was repeated except that the liquid ammonia treatment was omitted.

Comparative Example 7

The procedure of Example 7 was repeated except that the liquid ammonia treatment was omitted.

The woven fabrics of Examples 5 to 7 and Comparative Examples 5 to 7 were subjected to a washing test (JIS L-217 103 method) involving 1 cycle of washing or 10 cycles of washing, followed by tumble drying. The woven fabric was measured for its warp shrinkage. The results are shown in Table 2.

TABLE 2

| | | Rayon spun woven fabric | | Rayon filament × rayon spun woven fabric | | Cuprammonium rayon woven fabric | |
|---|---|---|---|---|---|---|---|
| | | E5 | CE5 | E6 | CE6 | E7 | CE7 |
| Warp shrinkage (%) | 1 cycle of washing | 1.4 | 5.8 | 2.5 | 23.0 | 1.0 | 6.5 |
| | 10 cycles of washing | 2.0 | 7.3 | 3.0 | 25.0 | 1.5 | 9.5 |

Example 8

A 7-count cotton denim 100% woven fabric (warp density 65 yarns/inch, weft density 43 yarns/inch) was impregnated with liquid ammonia at −34° C. for 10 seconds, heated to evaporate the ammonia, desized conventionally, and then treated with hot water in a flat state at 130° C. for 2 hours by means of a high-pressure beam dyeing machine, followed by tentering.

Example 9

Treatment as in Example 8 was done on an 8-count cotton/rayon (40/60) mix denim 100% woven fabric (warp density 69 yarns/inch, weft density 43 yarns/inch).

Example 10

Treatment as in Example 8 was done on a Tencel denim 100% woven fabric of 21-count warp yarn (warp density 115 yarns/inch) and 10-count weft yarn (weft density 54 yarns/inch).

Comparative Example 8

The procedure of Example 8 was repeated except that the hot water treatment was omitted.

Comparative Example 9

The procedure of Example 9 was repeated except that the hot water treatment was omitted.

Comparative Example 10

The procedure of Example 10 was repeated except that the hot water treatment was omitted.

The woven fabrics of Examples 8 to 10 and Comparative Examples 8 to 10 were examined for their shrinkage and tensile strength by the following tests. The results are shown in Table 3.

Shrinkage

The fabric was washed 1, 5 and 10 cycles according to JIS L-1096 F-2 method, followed by tumble drying. The fabric was measured for its warp and weft shrinkage.

Tensile strength

The weft tensile strength was measured according to JIS L-1096.

TABLE 3

| | | E8 | | CE8 | | E9 | | CE9 | | E10 | | CE10 | |
|---|---|---|---|---|---|---|---|---|---|---|---|---|---|
| | | Warp | Weft | Warp | Weft | Warp | Weft | Warp | Weft | Warp | Weft | Warp | Weft |
| Shrinkage (%) | 1 cycle of washing | 6.9 | −0.2 | 9.4 | −1.7 | 6.7 | −0.7 | 10.0 | −1.7 | 4.4 | 0.4 | 7.6 | 0.4 |
| | 5 cycles of washing | 7.8 | −0.4 | 12.2 | −1.6 | 8.0 | −0.3 | 12.2 | −1.3 | 4.4 | 0.4 | 8.4 | 0.5 |
| | 10 cycles of washing | 8.9 | −0.2 | 13.3 | −1.1 | 8.4 | 0.0 | 12.9 | −1.1 | 5.3 | 0.4 | 8.9 | 0.2 |
| Weft tensile strength (kg/cm$^2$) | | 92.3 | | 116.0 | | 109.0 | | 112.3 | | 172.7 | | 165.7 | |

Example 11

A cotton 100% woven fabric of 80-count two-folded yarn plain weave (warp density 149 yarns/inch, weft density 62 yarns/inch) was conventionally bleached, impregnated with liquid ammonia at −34° C. for 10 seconds, and heated to evaporate the ammonia. The fabric was then impregnated under tension with a 20 wt % caustic alkali at 25° C. for 60 seconds, neutralized, and washed with water, followed by dewatering, drying and tentering.

Comparative Example 11

The procedure of Example 11 was repeated except that the liquid ammonia treatment was omitted.

Comparative Example 12

The procedure of Example 11 was repeated except that the caustic alkali treatment was omitted.

The woven fabrics of Example 11 and Comparative Examples 11 and 12 were examined for their shrinkage and tensile strength as in Example 8. The results are shown in Table 4.

TABLE 4

| | | E11 | | CE11 | | CE12 | |
|---|---|---|---|---|---|---|---|
| | | Warp | Weft | Warp | Weft | Warp | Weft |
| Shrinkage (%) | 1 cycle of washing | 0.7 | 1.5 | 1.3 | 2.2 | 1.1 | 2.7 |
| | 5 cycles of washing | 0.7 | 1.8 | 2.0 | 2.2 | 1.6 | 3.1 |
| | 10 cycles of washing | 1.1 | 1.8 | 2.4 | 2.5 | 1.8 | 3.3 |
| Weft tensile strength (kgf) | | 42.3 | | 39.0 | | 39.4 | |

Example 12

A 40-count two-folded yarn single tuck ("KANOKO") (30 inches×18 gauge) cotton 100% knit was conventionally bleached and mercerized, impregnated with liquid ammonia at −34° C. for 10 seconds, and heated to evaporate the ammonia. The fabric was then impregnated with a 16 wt % caustic alkali at 25° C. for 50 seconds, neutralized, and washed with water, followed by dewatering, drying and tentering.

Example 13

The procedure of Example 12 was repeated except that the mercerizing treatment was omitted.

Comparative Example 13

The procedure of Example 12 was repeated except that the caustic alkali treatment was omitted.

Comparative Example 14

The procedure of Example 13 was repeated except that the caustic alkali treatment was omitted.

The woven fabrics of Examples 12 and 13 and Comparative Examples 13 and 14 were examined for their washing shrinkage as in Example 8 and for their burst strength according to JIS L-1018 Mullen method. The results are shown in Table 5.

TABLE 5

| | | E12 | | E13 | | CE13 | | CE14 | |
|---|---|---|---|---|---|---|---|---|---|
| | | Warp | Weft | Warp | Weft | Warp | Weft | Warp | Weft |
| Shrinkage (%) | 1 cycle of washing | 5.2 | 6.8 | 5.9 | 7.2 | 8.5 | 7.5 | 9.0 | 7.9 |
| | 5 cycles of washing | 5.3 | 7.5 | 6.1 | 7.4 | 8.8 | 8.0 | 9.9 | 8.5 |
| | 10 cycles of washing | 5.7 | 8.0 | 6.2 | 8.5 | 9.5 | 8.8 | 10.3 | 9.0 |
| Burst strength (kg/cm$^2$) | | 10.5 | | 10.1 | | 9.1 | | 8.7 | |

The following examples illustrate high-temperature alkali treatment.

Examples 14–17

A plain weave cotton 100% fabric of 40-count single yarn (warp density 132 yarns/inch, weft density 71 yarns/inch) was conventionally bleached, impregnated with liquid ammonia at −34° C. for 10 seconds, and heated to evaporate the ammonia. The fabric was then impregnated under no tension with a caustic alkali solution having an alkali concentration and a temperature as shown in Table 6 for a time as shown in Table 6, neutralized, and washed with water, followed by dewatering, drying and tentering.

The fabrics of Examples 14 to 17 were examined for shrinkage and tensile strength as in Example 1. The results are shown in Table 6.

TABLE 6

| | | E14 | | E15 | | E16 | | E17 | |
|---|---|---|---|---|---|---|---|---|---|
| | | Caustic alkali treatment | | | | | | | |
| | | 130° C. × 2 hr. | | 130° C. × 2 hr. | | 130° C. × 2 hr. | | 130° C. × 2 hr. | |
| | | Alkali concentration (wt %) | | | | | | | |
| | | 0.5 | | 1.0 | | 3.0 | | 5.0 | |
| | | Warp | Weft | Warp | Weft | Warp | Weft | Warp | Weft |
| Shrinkage (%) | 1 cycle of washing | 1.8 | −0.1 | 1.9 | −0.2 | 1.7 | 0.1 | 1.3 | −0.1 |
| | 5 cycles of washing | 2.1 | −0.6 | 2.2 | −0.5 | 1.7 | −0.6 | 1.6 | −0.6 |
| | 10 cycles of washing | 2.3 | −0.9 | 2.6 | −0.7 | 2.1 | −0.4 | 1.9 | −0.8 |
| Tensile strength (kgf) | | 93.3 | 45.0 | 88.0 | 45.7 | 82.3 | 44.0 | 83.7 | 42.3 |

Examples 18–19 & Comparative Examples 15–16

A cotton 100% plain weave fabric (warp: 50 count, density 148 yarns/inch, weft: 50 count, density 80 yarns/inch) was impregnated with liquid ammonia at −34° C. for 20 seconds, heated to evaporate the ammonia, and then treated with hot water at 130° C. for 1 hour in a flat state by means of a high-pressure beam dyeing machine.

Figure 2:
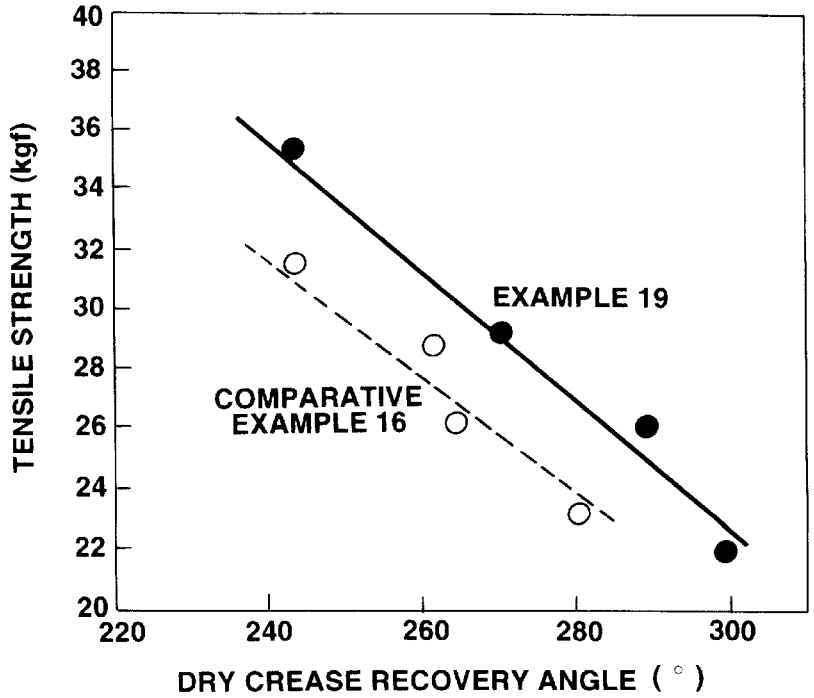
FIG. 2 is a graph showing the dry crease-proof property vs. the tensile strength of the fabric pieces treated in Example 19 and Comparative Example 16.

Thereafter, the fabric was subjected to resin treatment by preparing a resin solution according to the formulation shown in Tables 7 and 8 and applying it by a pad drying method. The resin treatment included the application of the resin solution by a mangle with a squeeze rate set at 60%, pre-drying at 85° C. for 15 minutes, and heat treatment under the conditions as shown in Tables 7 and 8. The thus obtained fabrics of Examples 18 and 19 were examined for their dry crease-proof property and tensile strength. The results are shown in Tables 7 and 8. The relationship of the tensile strength to the dry crease-proof property is shown in FIGS. 1 and 2. It is noted that the fabric was measured for its tensile strength and dry crease-proof property according to JIS L-1096.

Comparative Examples 15 and 16 were the same as Examples 18 and 19, respectively, except that the hot water treatment was omitted.

TABLE 7

| | | E18 | | | | CE15 | | | |
|---|---|---|---|---|---|---|---|---|---|
| Hot water treatment | | High-pressure beam dyeing machine | | | | None | | | |
| Resin formulation (g/100 ml) | LNB20*1 | 20 | 15 | 10 | 5 | 20 | 15 | 10 | 5 |
| | Zinc borofluoride*2 | 1 | 1 | 1 | 1 | 1 | 1 | 1 | 1 |
| | FW*4 | 2 | 2 | 2 | 2 | 2 | 2 | 2 | 2 |
| | PE-140*5 | 1 | 1 | 1 | 1 | 1 | 1 | 1 | 1 |
| | PEG200*6 | 3 | 3 | 3 | 3 | 3 | 3 | 3 | 3 |
| Heat treatment | Temperature (° C.) | 140 | 140 | 140 | 140 | 140 | 140 | 140 | 140 |
| | Time (min.) | 6 | 6 | 6 | 6 | 6 | 6 | 6 | 6 |
| Fabric properties | Tensile strength (kgf) | 23.6 | 24.2 | 26.1 | 29.8 | 20.9 | 23.2 | 25.3 | 29.6 |
| | Dry crease-proof property(°) | 300 | 287 | 270 | 241 | 290 | 271 | 248 | 225 |

TABLE 8

| | | E19 | | | | CE16 | | | |
|---|---|---|---|---|---|---|---|---|---|
| Hot water treatment | | High-pressure beam dyeing machine | | | | None | | | |
| Resin formulation (g/100 ml) | LNB20*1 | 20 | 15 | 10 | 5 | 20 | 15 | 10 | 5 |
| | Cat.M*3 | 3 | 3 | 3 | 3 | 3 | 3 | 3 | 3 |
| | FW*4 | 2 | 2 | 2 | 2 | 2 | 2 | 2 | 2 |
| | PE-140*5 | 1 | 1 | 1 | 1 | 1 | 1 | 1 | 1 |
| | PEG200*6 | 3 | 3 | 3 | 3 | 3 | 3 | 3 | 3 |
| Heat treatment | Temperature (° C.) | 160 | 160 | 160 | 160 | 160 | 160 | 160 | 160 |
| | Time (min.) | 2 | 2 | 2 | 2 | 2 | 2 | 2 | 2 |
| Fabric properties | Tensile strength (kgf) | 22.0 | 26.2 | 29.2 | 35.3 | 27.9 | 28.5 | 30.5 | 35.3 |
| | Dry crease-proof property (°) | 300 | 290 | 271 | 244 | 281 | 265 | 262 | 240 |

*1Riken Resin LNB20: Cellulose-reactive N-methylol resin, solids 40%, by Miki Riken Kogyo K.K.
*2Zinc borofluoride: Aqueous solution of 45% zinc borofluoride by Morita Chemical K.K.
*3Cat.M: Magnesium chloride catalyst by Dai-Nihon Ink Chemical Industry K.K.
*4Sumitex buffer FW: Formaldehyde scavenger by Sumitomo Chemical K.K.
*5Meikatex PE-140: Polyethylene softener by Meisei Chemical K.K.
*6PEG200: Polyethylene glycol by Sanyo Chemicals K.K.

It is noted that the resin solution was prepared by adding water to the chemicals of the formulation shown in Tables 7 and 8 to a total volume of 100 ml.

Example 20 and Comparative Example 17

Figure 3:
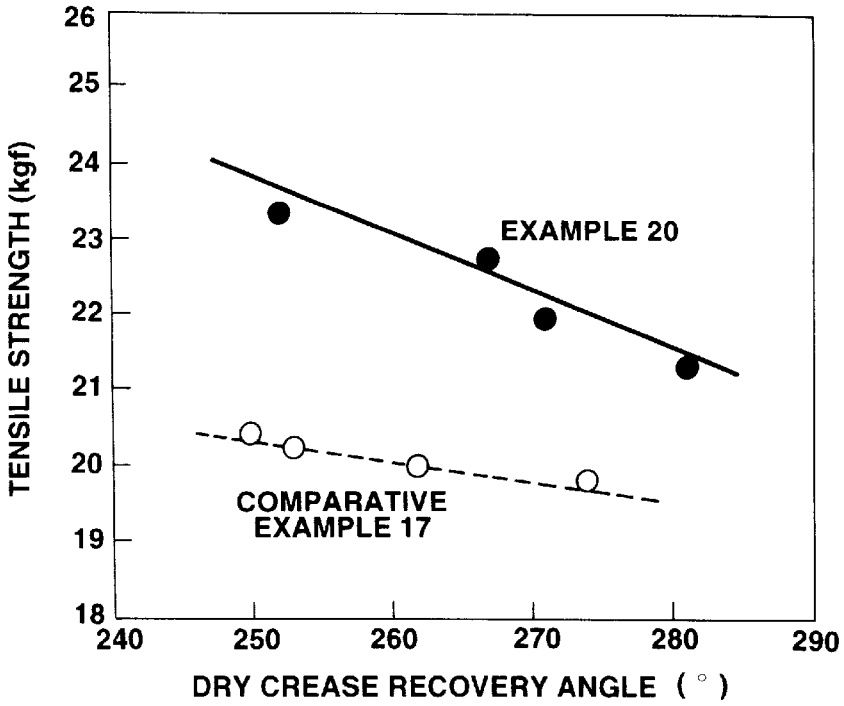
FIG. 3 is a graph showing the dry crease-proof property vs. the tensile strength of the fabric pieces treated in Example 20 and Comparative Example 17.

A cotton 100% plain weave fabric as used in Example 18 was impregnated with liquid ammonia at −34° C. for 10 seconds, heated to evaporate the ammonia, treated under no tension with hot water at 130° C. for 1 hour by means of a high-pressure liquid flow dyeing machine, and finally resin finished using the resin formulation and conditions shown in Table 9. The thus treated fabric of Example 20 was measured for its physical properties as in Example 18. The results are shown in Table 9 and FIG. 3.

Comparative Example 17 was the same as Example 20 except that the hot water treatment was omitted.

Example 21 and Comparative Example 18

Figure 4:
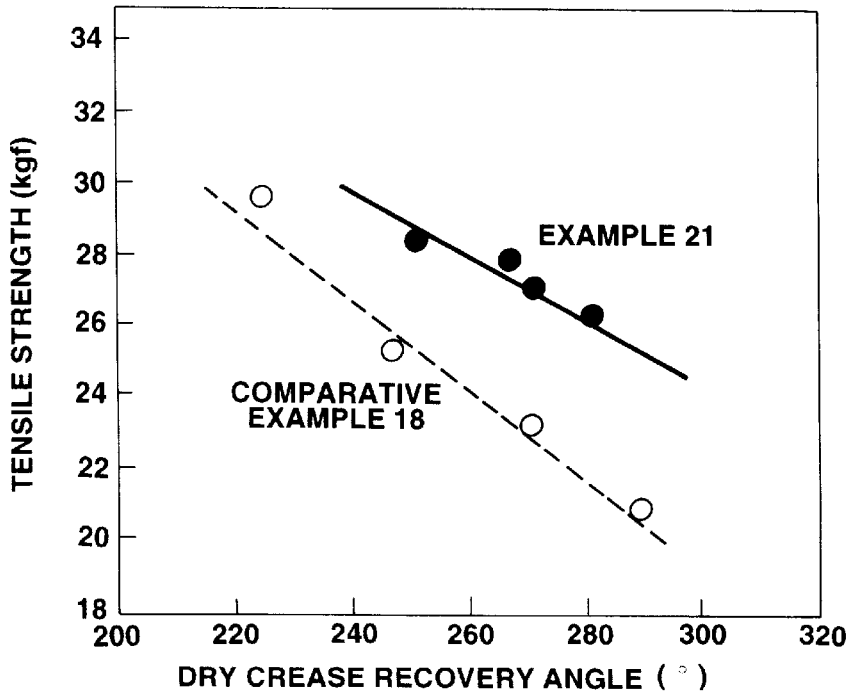
FIG. 4 is a graph showing the dry crease-proof property vs. the tensile strength of the fabric pieces treated in Example 21 and Comparative Example 18.

A cotton 100% plain weave fabric as used in Example 18 was impregnated with liquid ammonia at −34° C. for 20 seconds, heated to evaporate the ammonia, treated under tension with 20 wt % caustic soda at 25° C. for 60 seconds by means of a conventional mercerizing machine, and finally resin finished using the resin formulation and conditions shown in Table 10. The thus treated fabric of Example 21 was measured for its physical properties as in Example 18. The results are shown in Table 10 and FIG. 4.

Comparative Example 18 was the same as Example 21 except that the caustic soda treatment was omitted.

TABLE 9

| | | E20 | | | | CE17 | | | |
|---|---|---|---|---|---|---|---|---|---|
| Hot water treatment | | High-pressure liquid flow dyeing machine | | | | None | | | |
| Resin formulation (g/100 ml) | LNB20*1 | 20 | 15 | 10 | 5 | 20 | 15 | 10 | 5 |
| | Zinc borofluoride*2 | 1 | 1 | 1 | 1 | 1 | 1 | 1 | 1 |
| | FW*4 | 2 | 2 | 2 | 2 | 2 | 2 | 2 | 2 |
| | PE-140*5 | 1 | 1 | 1 | 1 | 1 | 1 | 1 | 1 |
| | PEG200*6 | 3 | 3 | 3 | 3 | 3 | 3 | 3 | 3 |
| Heat treatment | Temperature (° C.) | 140 | 140 | 140 | 140 | 140 | 140 | 140 | 140 |
| | Time (min.) | 6 | 6 | 6 | 6 | 6 | 6 | 6 | 6 |
| Fabric properties | Tensile strength (kgf) | 21.4 | 22.0 | 22.8 | 21.4 | 19.8 | 20.0 | 20.2 | 20.4 |
| | Dry crease-proof property (°) | 281 | 271 | 267 | 252 | 274 | 262 | 253 | 250 |

TABLE 10

| | | E21 | | | | CE18 | | | |
|---|---|---|---|---|---|---|---|---|---|
| Caustic alakali treatment | | Mercerizing machine | | | | None | | | |
| Resin formulation (g/100 ml) | LNB20*1 | 20 | 15 | 10 | 5 | 20 | 15 | 10 | 5 |
| | Zinc borofluoride*2 | 1 | 1 | 1 | 1 | 1 | 1 | 1 | 1 |
| | FW*4 | 2 | 2 | 2 | 2 | 2 | 2 | 2 | 2 |
| | PE-140*5 | 1 | 1 | 1 | 1 | 1 | 1 | 1 | 1 |
| | PEG200*6 | 3 | 3 | 3 | 3 | 3 | 3 | 3 | 3 |
| Heat treatment | Temperature (° C.) | 140 | 140 | 140 | 140 | 140 | 140 | 140 | 140 |
| | Time (min.) | 6 | 6 | 6 | 6 | 6 | 6 | 6 | 6 |
| Fabric properties | Tensile strength (kgf) | 26.4 | 27.0 | 27.8 | 28.4 | 20.9 | 23.2 | 25.3 | 29.6 |
| | Dry crease-proof property (°) | 281 | 271 | 267 | 252 | 290 | 271 | 248 | 225 |

Example 22 and Comparative Example 19

Figure 5:
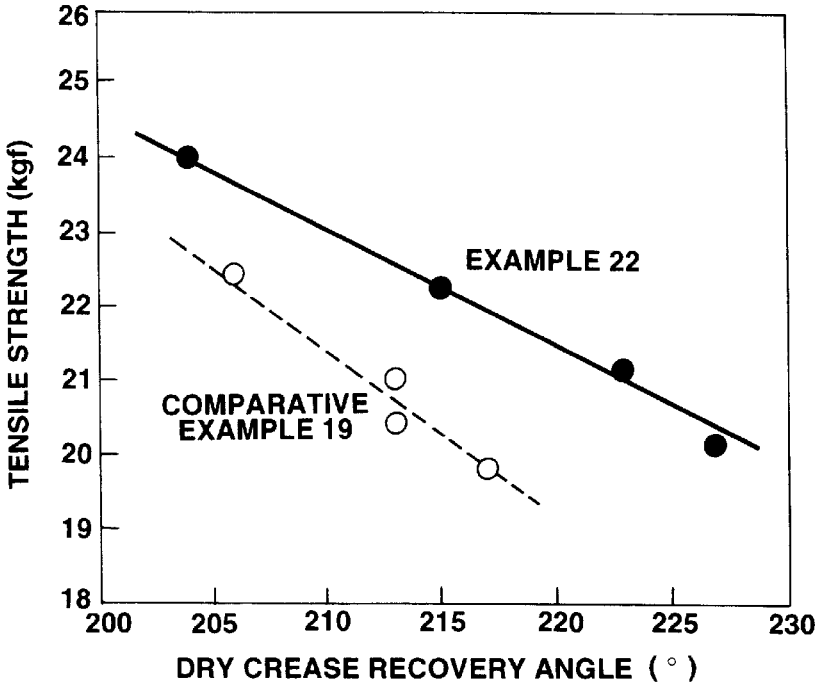
FIG. 5 is a graph showing the dry crease-proof property vs. the tensile strength of the fabric pieces treated in Example 22 and Comparative Example 19.

A linen 100% plain weave fabric (warp: hemp, 60 count, density 60 yarns/inch, weft: hemp, 60 count, density 52 yarns/inch) was impregnated with liquid ammonia at −34° C. for 10 seconds, heated to evaporate the ammonia, treated under no tension with hot water at 130° C. for 1 hour by means of a high-pressure liquid flow dyeing machine, and finally resin finished using the resin formulation and conditions shown in Table 11. The thus treated fabric of Example 22 was measured for its physical properties as in Example 18. The results are shown in Table 11 and FIG. 5.

Comparative Example 19 was the same as Example 22 except that the hot water treatment was omitted.

TABLE 11

| | | E22 | | | | CE19 | | | |
|---|---|---|---|---|---|---|---|---|---|
| Hot water treatment | | High-pressure liquid flow dyeing machine | | | | None | | | |
| Resin formulation (g/100 ml) | LNB20*1 | 18 | 15 | 12 | 9 | 18 | 15 | 12 | 9 |
| | Zinc borofluoride*2 | 1 | 1 | 1 | 1 | 1 | 1 | 1 | 1 |
| | FW*4 | 2 | 2 | 2 | 2 | 2 | 2 | 2 | 2 |
| | PE-140*5 | 1 | 1 | 1 | 1 | 1 | 1 | 1 | 1 |
| | PEG200*6 | 3 | 3 | 3 | 3 | 3 | 3 | 3 | 3 |
| Heat treatment | Temperature (° C.) | 120 | 120 | 120 | 120 | 120 | 120 | 120 | 120 |
| | Time (min.) | 6 | 6 | 6 | 6 | 6 | 6 | 6 | 6 |
| Fabric properties | Tensile strength (kgf) | 20.2 | 21.2 | 22.2 | 24.0 | 19.8 | 20.4 | 21.0 | 22.4 |
| | Dry crease-proof property (°) | 227 | 223 | 215 | 204 | 217 | 213 | 213 | 206 |

Example 23 and Comparative Example 20

Figure 6:
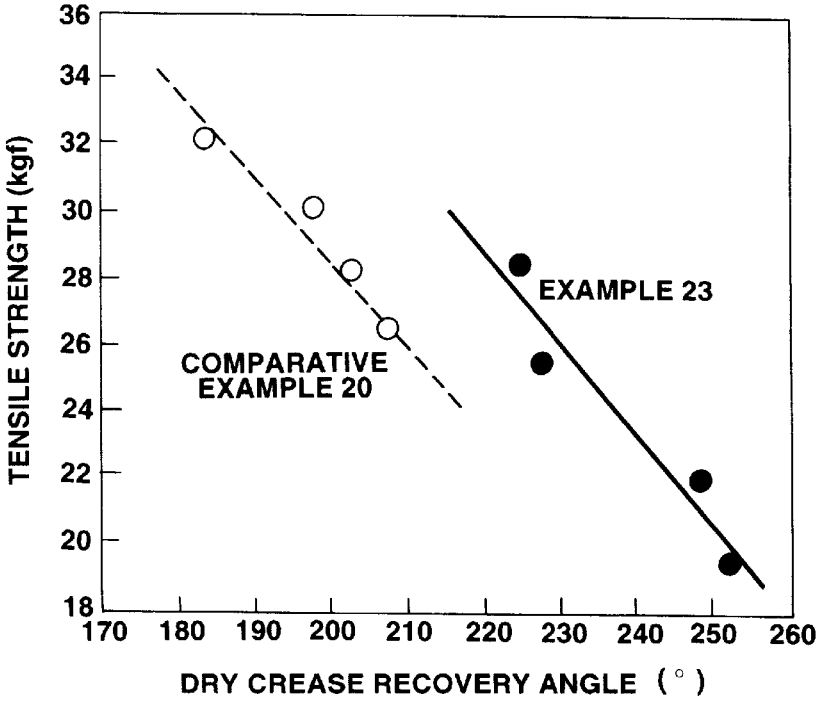
FIG. 6 is a graph showing the dry crease-proof property vs. the tensile strength of the fabric pieces treated in Example 23 and Comparative Example 20.

A rayon 100% plain weave fabric (warp: 30 count, density 68 yarns/inch, weft: 30 count, density 60 yarns/inch) was impregnated with liquid ammonia at −34° C. for 10 seconds, and heated to evaporate the ammonia, treated under no tension with hot water at 130° C. for 1 hour by means of a high-pressure liquid flow dyeing machine, and finally resin finished using the resin formulation and conditions shown in Table 12. The thus treated fabric of Example 23 was measured for its physical properties as in Example 18. The results are shown in Table 12 and FIG. 6.

Comparative Example 20 was the same as Example 23 except that the hot water treatment was omitted.

TABLE 12

| | | E23 | | | | CE20 | | | |
|---|---|---|---|---|---|---|---|---|---|
| Hot water treatment | | High-pressure liquid flow dyeing machine | | | | None | | | |
| Resin formulation (g/100 ml) | LNB20*1 | 20 | 15 | 10 | 5 | 20 | 15 | 10 | 5 |
| | Zinc borofluoride*2 | 1 | 1 | 1 | 1 | 1 | 1 | 1 | 1 |

TABLE 12-continued

| | | E23 | | | | CE20 | | | |
|---|---|---|---|---|---|---|---|---|---|
| | FW*4 | 2 | 2 | 2 | 2 | 2 | 2 | 2 | 2 |
| | PE-140*5 | 1 | 1 | 1 | 1 | 1 | 1 | 1 | 1 |
| | PEG200*6 | 3 | 3 | 3 | 3 | 3 | 3 | 3 | 3 |
| Heat treatment | Temperature (° C.) | 120 | 120 | 120 | 120 | 120 | 120 | 120 | 120 |
| | Time (min.) | 10 | 10 | 10 | 10 | 10 | 10 | 10 | 10 |
| Fabric properties | Tensile strength (kgf) | 19.6 | 22.0 | 25.6 | 19.6 | 26.6 | 25.8 | 28.2 | 32.2 |
| | Dry crease-proof property (°) | 248 | 249 | 227 | 230 | 207 | 205 | 202 | 184 |

Example 24 and Comparative Example 21

A cotton 100% plain weave fabric as used in Example 18 was impregnated with liquid ammonia at −34° C. for 20 seconds, heated to evaporate the ammonia, and treated under no tension with hot water at 130° C. for 1 hour by means of a high-pressure liquid flow dyeing machine. Finally as resin treatment, a softener and polyethylene glycol as shown in Table 13 were previously applied to the fabric by a pad drying method, and a crosslinking reaction (VP reaction) was carried out in formaldehyde and sulfur dioxide gas at 50 to 120° C. for 10 minutes. The amount of formaldehyde bonded was 0.3% by weight.

The thus treated fabric of Example 24 was measured for its physical properties as in Example 18. The results are shown in Table 13.

Comparative Example 21 was the same as Example 24 except that the hot water treatment was omitted.

TABLE 13

| | | E24 | CE21 |
|---|---|---|---|
| Hot water treatment | | High-pressure beam dyeing machine | None |
| Treating agent (g/100 ml) | PE-140*5 | 1 | 1 |
| | PEG200*6 | 3 | 3 |
| Fabric properties | Tensile strength (kgf) | 43.0 | 40.3 |
| | Dry crease-proof property (°) | 258 | 246 |

Example 25 and Comparative Example 22

A 40-count two-folded yarn single tuck ("KANOKO") (30 inches×18 gauge) cotton 100% knit was conventionally bleached, impregnated with liquid ammonia at −34° C. for 20 seconds, heated to evaporate the ammonia, treated under no tension with hot water at 130° C. for 1 hour by means of a high-pressure liquid flow dyeing machine, dewatered and dried. Resin treatment was then carried out by means of a tenter. The treating resin formulation and conditions were the same as in Example 18. The fabric was examined for the shrinkage (warp+weft) after washing and tumble drying according to JIS L-217 103 method and for its burst strength according to JIS L-1018 Mullen method. The results are shown in Table 14.

Comparative Example 22 was the same as Example 25 except that the fabric was washed under no tension with warm water at 60° C. for 1 hour instead of the hot water treatment.

TABLE 14

| | | Resin concentration | | | | | | | |
|---|---|---|---|---|---|---|---|---|---|
| | | 5% | | 10% | | 15% | | 20% | |
| | | E25 | CE22 | E25 | CE22 | E25 | CE22 | E25 | CE22 |
| Warp + weft shrinkage (%) | 1 cycle of washing | 10.3 | 13.5 | 6.8 | 9.8 | 4.3 | 7.3 | 2.5 | 4.1 |
| | 5 cycles of washing | 11.3 | 15.8 | 7.9 | 11.3 | 6.3 | 8.7 | 3.4 | 6.2 |
| | 10 cycles of washing | 11.5 | 16.4 | 8.0 | 12.4 | 6.7 | 9.5 | 4.5 | 7.3 |
| Burst strength (kg/cm$^2$) | | 7.0 | 7.2 | 5.1 | 5.2 | 4.4 | 4.2 | 4.4 | 4.1 |

Example 26 and Comparative Example 23

The procedure of Example 25 was repeated except that the same knit fabric as in Example 21 was treated under tension with 16 wt % caustic soda at 25° C. for an impregnating time of 50 seconds by means of a conventional mercerizing machine prior to the liquid ammonia treatment. The fabric was examined for its washing shrinkage (warp +weft) and its burst strength as in Example 25. The results are shown in Table 15.

Comparative Example 23 was the same as Example 26 except that the fabric was washed under no tension with warm water at 60° C. for 1 hour instead of the hot water treatment.

TABLE 15

| | | Resin concentration | | | | | | | |
|---|---|---|---|---|---|---|---|---|---|
| | | 5% | | 10% | | 15% | | 20% | |
| | | E26 | CE23 | E26 | CE23 | E26 | CE23 | E26 | CE23 |
| Warp + weft shrinkage (%) | 1 cycle of washing | 9.2 | 12.8 | 5.7 | 8.8 | 3.7 | 6.2 | 2.4 | 3.7 |
| | 5 cycles of washing | 10.4 | 14.9 | 6.7 | 10.1 | 5.7 | 7.6 | 3.3 | 5.5 |
| | 10 cycles of washing | 10.6 | 15.5 | 7.5 | 11.7 | 5.9 | 8.7 | 4.4 | 6.7 |
| Burst strength (kg/cm$^2$) | | 8.3 | 8.3 | 6.2 | 6.1 | 5.2 | 5.2 | 5.1 | 4.8 |

Example 27 and Comparative Example 24

The procedure of Example 25 was repeated except that the same knit fabric as in Example 25 was treated under tension with 16 wt % caustic soda at 25° C. for an impregnating time of 50 seconds by means of a conventional mercerizing machine instead of the hot water treatment. The fabric was examined for its washing shrinkage (warp+weft) and its burst strength as in Example 25. The results are shown in Table 16.

Comparative Example 24 was the same as Example 27 except that the mercerizing treatment was omitted.

TABLE 16

| | | Resin concentration | | | | | | | |
|---|---|---|---|---|---|---|---|---|---|
| | | 5% | | 10% | | 15% | | 20% | |
| | | E27 | CE24 | E27 | CE24 | E27 | CE24 | E27 | CE24 |
| Warp + weft shrinkage (%) | 1 cycle of washing | 8.3 | 13.5 | 5.2 | 9.9 | 4.0 | 6.8 | 2.8 | 4.8 |
| | 5 cycles of washing | 9.2 | 15.1 | 6.5 | 11.2 | 5.5 | 7.5 | 3.5 | 6.2 |
| | 10 cycles of washing | 9.8 | 15.9 | 7.3 | 11.9 | 5.7 | 8.2 | 3.9 | 6.9 |
| Burst strength (kg/cm$^2$) | | 8.3 | 6.5 | 7.4 | 5.8 | 6.2 | 4.7 | 5.5 | 4.3 |

Example 28

A plain weave cotton 100% fabric of 50-count (warp density 148 yarns/inch, weft density 80 yarns/inch) bleached conventionally was treated with liquid ammonia at −34° C. for 10 seconds, and heated to evaporate the ammonia. The fabric was wound onto beam and was treated with hot water at 98° C. for 2 hours in a water bath under tension, followed by hydrating and drying.

Comparative Example 25

The procedure of Example 28 was repeated except that the hot water treatment was omitted.

Comparative Example 26

The procedure of Example 28 was repeated except that the water treatment was conducted at 20° C.

The fabrics of Example 28 and Comparative Examples 25 and 26 were subjected to washing (JIS L-0217 103 method) and then tumble drying to measure warp shrinkage. The results are shown in Table 17.

TABLE 17

| | | E28 | CE25 | CE26 |
|---|---|---|---|---|
| Shrinkage (%) (Warp) | 1 cycle of washing | 0.9 | 3.3 | 2.0 |
| | 3 cycles of washing | 1.3 | 3.8 | 2.5 |
| | 5 cycles of washing | 1.6 | 4.3 | 3.0 |

Example 29

A plain weave cotton 100% fabric of 50-count single yarn (warp density 144 yarns/inch, weft density 81 yarns/inch) bleached conventionally was treated with liquid ammonia at −34° C. for 10 seconds, and heated to evaporate the ammonia. Then the fabric was wound onto the beam, and was treated with 10.0 wt % sodium carbonate (soda ash) solution at 130° C. for 2 hours under tension, followed by neutralizing, dehydrating and drying.

Example 30

A plain weave spun rayon 100% fabric of 40-count single yarn (warp density 100 yarns/inch, weft density 80 yarns/inch) bleached conventionally was treated with liquid ammonia at −34° C. for 10 seconds, and heated to evaporate the ammonia. Then the fabric was treated with 3.0 wt % sodium carbonate (soda ash) solution at 130° C. for 2 hours under no tension by means of the high pressure drum dyeing machine, followed by dehydrating and drying.

The results for washing shrinkage of the above woven fabric according to tumble drying by JIS L-0217 103 method shown in Table 18.

TABLE 18

| | | | E29 | E30 |
|---|---|---|---|---|
| Condition of alkali treatment | State of tension | | tension | no tension |
| | Concentration of sodium carbonate (%) | | 10.0 | 3.0 |
| | Temperature (° C.) | | 130 | 130 |
| | Treatment time | | 2 hrs | 2 hrs |
| Shrinkage (%) (F2- tumble) | warp | 1 cycle of washing | 1.8 | 0.7 |
| | | 3 cycles of washing | 2.2 | 1.1 |
| | | 5 cycles of washing | 2.5 | 1.2 |
| | weft | 1 cycle of washing | −0.2 | 0.1 |
| | | 3 cycles of washing | −0.6 | 0.5 |
| | | 5 cycles of washing | −0.8 | 0.6 |
| Weft tension strength (kgf) | | | 45.0 | 23.2 |

According to the present invention, improved crease or shrink-proof properties can be imparted to a cellulosic fiber-containing a structure without a substantial loss of fabric strength. Especially, improved crease or shrink-proof properties can be imparted to even thin, low strength fabrics while maintaining a practically acceptable strength. In the embodiment wherein the shrink-proof treatment is followed by resin treatment, the balance of the fabric strength and the crease or shrink-proof properties are further improved so that improved shrink-proof properties can be imparted while minimizing the loss in fabric strength.

Although some preferred embodiments have been described, many modifications and variations may be made thereto in the light of the above explanations. It is, therefore, to be understood that within the scope of the appended claims, the invention may be practiced otherwise than as specifically described.

What is claimed is:

1. A method for the shrink-proof treatment of a natural cellulosic fiber textile, comprising the steps of:

treating the fiber textile with liquid ammonia, thereby converting the cellulose I or II crystalline structure in the fiber textile to cellulose III crystalline structure so that the content of cellulose III crystalline structure in the fiber textile is 10 to 35% based on the entire crystals, and treating the fiber textile under tension or under no tension with hot water at a temperature of 100 to 150° C., thereby obtaining a natural cellulosic fiber textile having a minimal shrinkage after washing.

2. The method of claim 1, which further comprises treating the fiber textile with a resin after the hot water treatment.

3. The method of claim 2, wherein the resin treatment uses formaldehyde.

4. A method for the shrink-proof treatment of a natural cellulosic fiber textile, comprising the steps of:

treating the fiber textile with liquid ammonia, thereby converting the cellulose I or II crystalline structure in the fiber textile to cellulose III crystalline structure so that the content of cellulose III crystalline structure in the fiber textile is 10 to 35% based on the entire crystals, and subsequently treating the fiber textile under tension or under no tension with hot water at a temperature of 100 to 150° C., thereby obtaining a natural cellulosic fiber textile having a minimal shrinkage after washing.

5. The method of claim 4, which further comprises treating the fiber textile with a resin after the hot water treatment.

6. The method of claim 5, wherein the resin treatment uses formaldehyde.

* * * * *